US006416241B1

(12) United States Patent
Adams

(10) Patent No.: US 6,416,241 B1
(45) Date of Patent: Jul. 9, 2002

(54) PENCIL HAVING A ROTATABLE FERRULE FOR EXPOSING THE ERASER

(76) Inventor: Gordon Adams, 25 Mac Kinnon Pl., East Lyme, CT (US) 06333

( * ) Notice: Subject to any disclaimer, the term of this patent is extended or adjusted under 35 U.S.C. 154(b) by 0 days.

(21) Appl. No.: 09/906,262

(22) Filed: Jul. 17, 2001

(51) Int. Cl.[7] ..... B43K 25/00

(52) U.S. Cl. ..... 401/52; 401/49; 15/105.51; 15/424

(58) Field of Search ..... 401/52, 195, 49, 401/50; 15/105.51, 424

(56) References Cited

U.S. PATENT DOCUMENTS 174,466 A * 3/1876 Benson ..... 401/52
840,372 A * 1/1907 Rechendorfer ..... 401/52
1,985,307 A * 12/1934 Boast ..... 15/105.51
2,144,014 A * 1/1939 Finck ..... 15/105.51

* cited by examiner

*Primary Examiner*—David J. Walczak
(74) *Attorney, Agent, or Firm*—Timothy Thut Tyson; Ted Masters; Freilich, Hornbaker & Rosen

(57) ABSTRACT

A pencil (20) includes a threaded end (30). A threaded ferrule (24) surrounds an eraser (26), and threadably engages the threaded end (30). When the ferrule (24) is rotated, it screws down on the threaded end (30) thereby exposing an unused portion of the eraser (26). A stop mechanism (34) prevents the ferrule (24) from being unscrewed from the threaded end (30).

3 Claims, 4 Drawing Sheets

26
24
34
25
20
22

30
32
30
L1
22
28
32
28

26
L3
24
L2
34

26
31
L2
24
30
20
22
32

PENCIL HAVING A ROTATABLE FERRULE FOR EXPOSING THE ERASER

TECHNICAL FIELD

The present invention is directed generally to pencils having an eraser tip, and more particularly to an improved pencil which provides an increased erasing capacity. The pencil has a threaded end which cooperates with a threaded ferrule which, as the eraser wears down, can periodically be screwed down to expose an unused portion of the eraser.

BACKGROUND ART

Pencils having various forms of eraser holders are well known in the art. For example, U.S. Pat. No. 174,466 shows a combined rubber eraser holder and point protector. A tube surrounds the eraser. A sleeve threadably cooperates with the tube and can be screwed up or down to uncover more or less of the rubber.

U.S. Pat. No. 737,070 illustrates an eraser tip for lead pencils. A cylinder may be screwed up or down on the sleeve to expose the desired amount of eraser. The sleeve slips over the end of the pencil.

U.S. Pat. No. 1,136,094 discloses an eraser holder for pencils. The holder is attached to the end of the pencil. Jaws are placed around the eraser, and the combination is screwed into the threaded holder. In another embodiment, a threaded tip is attached to the end of the pencil, and a threaded eraser is screwed into the tip.

U.S. Pat. No. 1,153,799 comprises an eraser tip for pencils. The device includes a cylindrical sheet metal tube or sheath, a cylindrical stick or erasive material which fits snugly inside the sheath, and a narrow sheet metal band or ferrule which encircles and tightly clasps the base of the eraser stick.

U.S. Pat. No. 1,237,013 consists of an eraser holder for pencils. As the eraser wears down, a frangible ferrule may be broken off to expose more of the eraser.

DISCLOSURE OF INVENTION

Conventional wooden pencils only have about 3/16 of an inch of usable eraser. This means that most times the eraser is worn away while a large portion of the pencil remains. In these instances, a user is inclined to wastefully throw the pencil away. The present invention is directed to an improved pencil, which provides a user with more erasing capacity. In the present invention, the pencil and eraser tend to be worn equally, thereby dramatically extending the working life of the pencil. The extended eraser life of the present invention is effected by providing a threaded end on the pencil which cooperates with a threaded ferrule. The ferrule may be screwed progressively down on the threaded end as necessary to expose an unused portion of an elongated eraser.

In accordance with a preferred embodiment of the invention, the pencil includes an elongated body having an end which is sharpened, and an opposite end which is threaded. A threaded metal ferrule threadably engages the threaded end of pencil. An elongated rubber eraser is received by the ferrule and projects outward from the end of the pencil. When the eraser is worn down to near the end of the ferrule, the ferrule is screwed further onto the threaded end of the pencil thereby exposing an unused portion of the eraser. This process may be repeated numerous times during the working life of the pencil.

In accordance with an important aspect of the invention, the ferrule has at least one stop which engages the threaded end of the pencil. The stop permits the ferrule to be screwed down onto the threaded end for example in a clockwise direction, but prevents the ferrule from being unscrewed and removed from the pencil, for example in a counter clockwise direction.

In accordance with an important feature of the invention, the stop includes a pointed member or barb which digs into the threaded end when a user attempts to unscrew the ferrule.

Other features and advantages of the present invention will become apparent from the following detailed description, taken in conjunction with the accompanying drawings, which illustrate, by way of example, the principles of the invention.

BRIEF DESCRIPTION OF DRAWINGS

FIG. 2 is a side elevation view of the body of the pencil showing a threaded end;

MODES FOR CARRYING OUT THE INVENTION

Figures 1, 3, 4, 5, 6, 7:
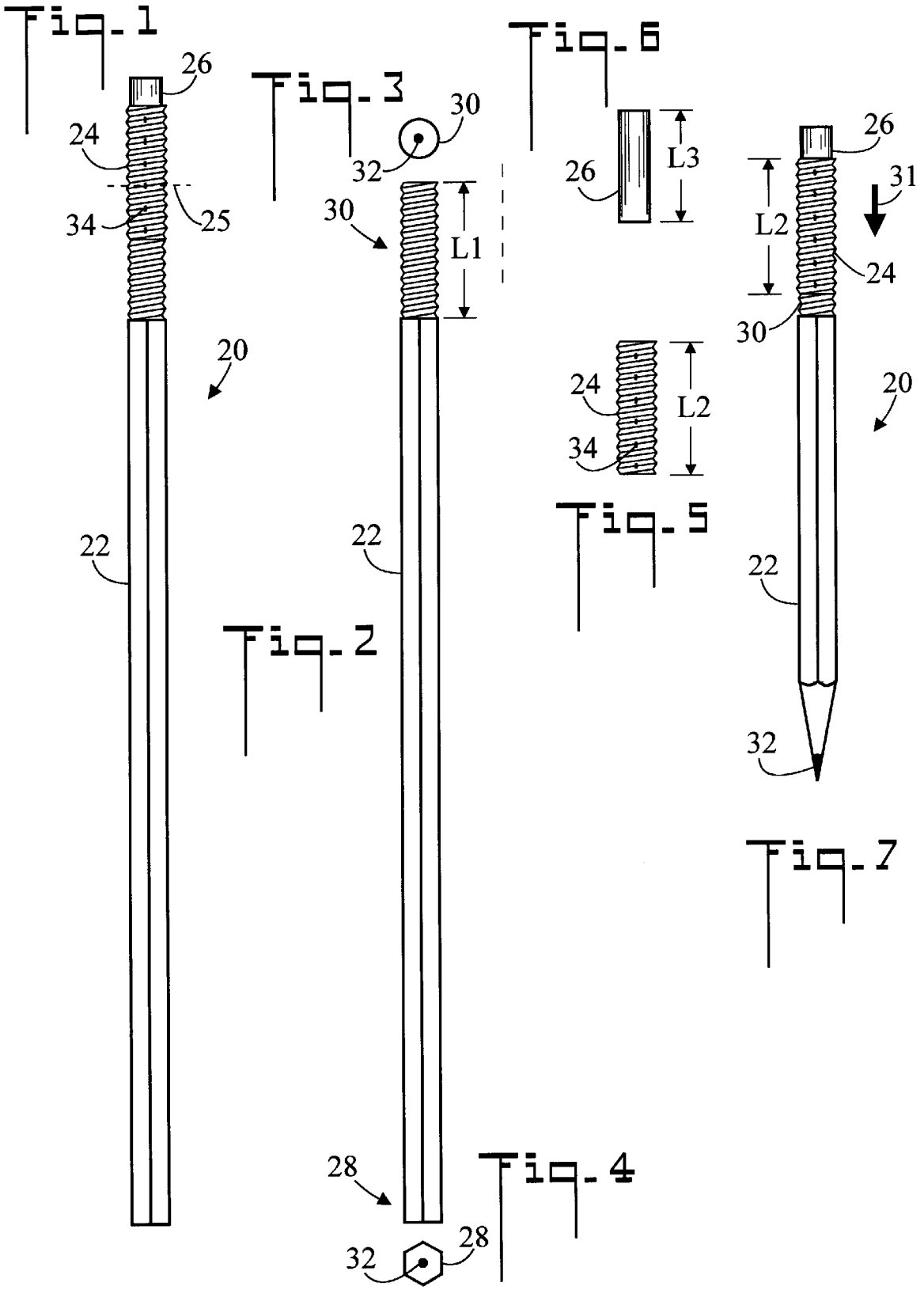
FIG. 1 is a side elevation view of a pencil in accordance with the present invention.
FIG. 3 is a top end view of the body.
FIG. 4 is a bottom end view of the body.
FIG. 5 is a side elevation view of a ferrule.
FIG. 6 is a side elevation view of an eraser.
FIG. 7 is a side elevation view of the pencil showing the ferrule screwed down on the threaded end to exposed an unused portion of the eraser.

Referring initially to FIG. 1, there is illustrated a side elevation view of a pencil in accordance with the present invention, generally designated as 20. Pencil 20 includes an elongated body 22, a ferrule 24, and an elongated eraser 26. Line 25 indicates the boundary between body 22 and eraser 26, which is hidden by ferrule 24 in the figure.

FIG. 2 is a side elevation view of body 22 which has a sharpening end 28 and an opposite threaded end 30. Threaded end 30 has a length of L1. In a preferred embodiment of the invention, just as is a conventional pencil, body 22 is fabricated from wood, and has a core 32 which contains a writing material (refer to FIGS. 3 and 4).

FIGS. 3 and 4 are top end and bottom end views, respectively, of body 22, showing threaded end 30 and sharpening end 28 respectively, and core 32.

FIG. 5 is a side elevation view of ferrule 24. In a preferred embodiment, ferrule 24 is fabricated of metal into a hollow cylinder of length L2 which is threaded so that it threadably engages threaded end 30 of body 22 of pencil 20 (refer to FIG. 1).

FIG. 6 is a side elevation view of eraser 26. Eraser 26 is cylindrical in shape, and has a length L3 which is much longer than the overall length (7/16 of an inch) of a conventional eraser. Eraser 26 is snugly received by ferrule 24 and projects outwardly therefrom (refer to FIG. 1). Eraser 26 is installed (pushed down) in ferrule 24 so that it substantially abuts threaded end 30.

FIG. 7 is a side elevation view of pencil 20 showing ferrule 24 screwed down on threaded end 30 in direction 31 to exposed an unused portion of eraser 26. That is, as eraser 26 is worn down by use, ferrule 24 may by progressively screwed further onto threaded end 30 of pencil 20 thereby exposing an unused portion of eraser 26. In this fashion, more eraser 26 is available to a user, thereby permitting pencil 20 to be used a longer time before being discarded for lack of an eraser.

Figure 8:
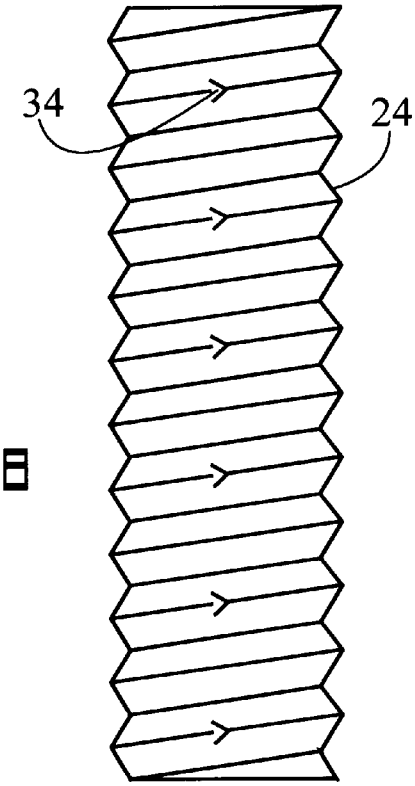
FIG. 8 is an enlarged side elevation view of the ferrule showing a plurality of stops.

FIG. 8 is an enlarged side elevation view of ferrule 24 showing a plurality of stops 34. Ferrule 24 has at least one stop 34 which engages threaded end 30 of pencil 20. Stop 34 permits ferrule 24 to be screwed onto threaded end 30 in a first direction 36 (refer to FIG. 9). Stop 34 prevents ferrule 24 from being screwed off of threaded end 30 in an opposite second direction. This is so that a child cannot remove ferrule 24 and eraser 26 from the end of pencil 20. In a preferred embodiment, stop 34 includes a pointed member which digs into threaded end 30 when ferrule 24 is turned in the second direction (also refer to FIG. 9). The stops 34 may be located on the ridges or valleys of the ferrule or on any other location.

Figure 9:
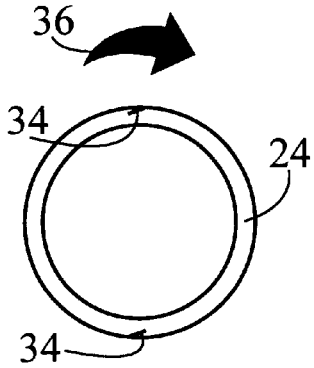
FIG. 9 is an enlarged top plan view of the ferrule of FIG. 8.

FIG. 9 is an enlarged top plan view of ferrule 24 of FIG. 8. Stop 34 comprises a pointed member which rides around threaded member 30 when ferrule 24 is turned in direction 36, but which digs into threaded member 30 and stops the rotation when a user attempts to rotate ferrule 24 so as to unscrew it from threaded end 30 in the direction opposite to 36. In a preferred embodiment, stop 30 is stamped as a "V" into the metal of ferrule 24, and has a depth of 1/64 of an inch.

Figure 10:
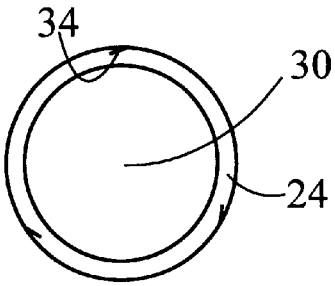
FIG. 10 is an enlarged top plan view of another embodiment of the ferrule.

FIG. 10 is an enlarged top plan view of another embodiment of ferrule 24. In this embodiment, stops 34 are spaced around ferrule 24 at 120° intervals, and dig or bite into threaded end 30 if a user attempts to take ferrule 24 off of threaded end 30.

Figure 11:
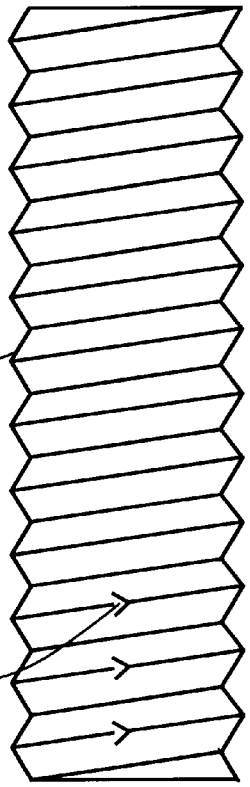
FIG. 11 is an enlarged side elevation view of a third embodiment of the ferrule.

FIG. 11 is an enlarged side elevation view of a third embodiment of ferrule 24. In this embodiment stops 34 are only located on the portion of ferrule 24 which initially engages threaded end 30. In this manner, stops 34 never engage eraser 26 which could be unwantingly scored.

In a preferred embodiment of the invention, threaded end 30 has threads which have a 1/16 inch pitch, and are 1/32 inch deep. The threads on ferrule 24 are shaped to threadably engage threaded end 30. As used herein the term "threads" embraces any form of ridges on one end of pencil body 22 which cooperate with grooves in ferrule 24 to permit a screwing down action of the ferrule 24 upon the end of the pencil 20.

It may be appreciated that the lengths of threaded end 30, ferrule 24, and eraser 26 can be adjusted to provide various amounts of additional erasing capacity. In a conventional pencil, L1=5/16", L2=9/16", and L3=7/16. Table 1 provides some examples of the percentage increase over a conventional pencil and eraser for various L1, L2, and L3 combinations:

TABLE 1

| | Length Values | | |
|---|---|---|---|
| | L1 | L2 | L3 |
| For a 100% increase | 8/16 | 12/16 | 10/16 |
| For a 200% increase | 11/16 | 15/16 | 13/16 |
| For a 300% increase | 14/16 | 18/16 | 16/16 |

Figure 12:
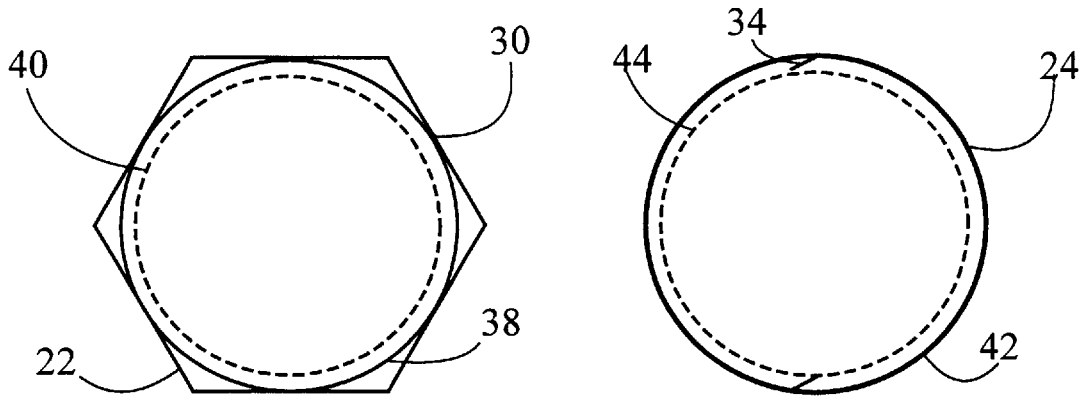
FIG. 12 is an enlarged top end view of the pencil and ferrule.

FIG. 12 is an enlarged top end view of body 22 of the pencil showing threaded end 30 and ferrule 24 disassembled and side by side. In this embodiment, the threads of threaded end 30 have an outside diameter 38 and an inside diameter 40. Ferrule 24 has threads having an outside diameter 42 and an inside diameter 44, which are dimensioned to threadably engage threaded end 30. The hexagonal shape outside the outside diameter 38 of the threads is the perimeter of the pencil below the threaded portion.

Figure 13:
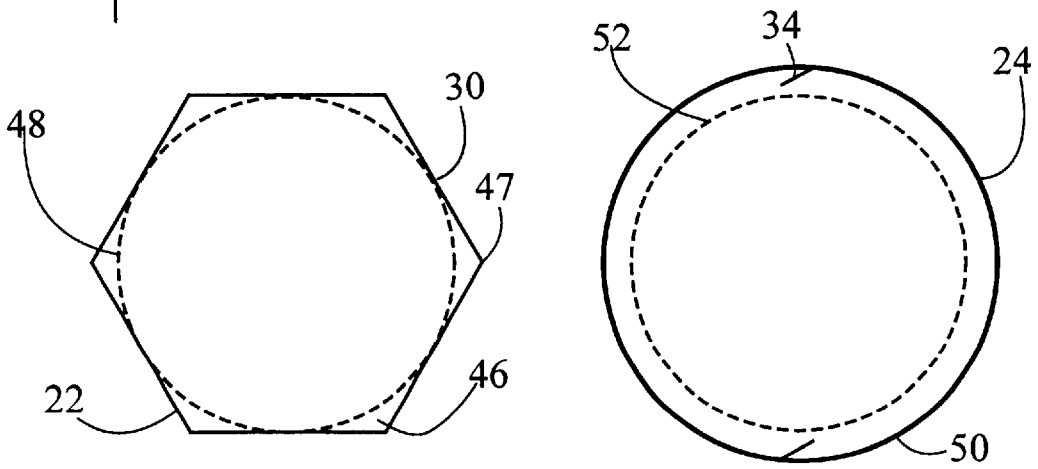
FIG. 13 is an enlarged top end view of a second embodiment of the pencil and ferrule.

FIG. 13 is an enlarged top end view of a second embodiment of body 22 of the pencil and ferrule 24 disassembled and side by side. The hexagonal body 22 has six outward projections 46. The threads on threaded end 30 can only be in the six outward projections instead of continuous as shown in FIG. 12. The threads have an outside diameter 47 and an inside diameter 48. Ferrule 24 has threads having an outside diameter 50 and an inside diameter 52, which are dimensioned to threadably engage threaded end 30. It is noted that the ferrule 24 of FIG. 13 is larger than the ferrule 24 of FIG. 12.

Figure 14:
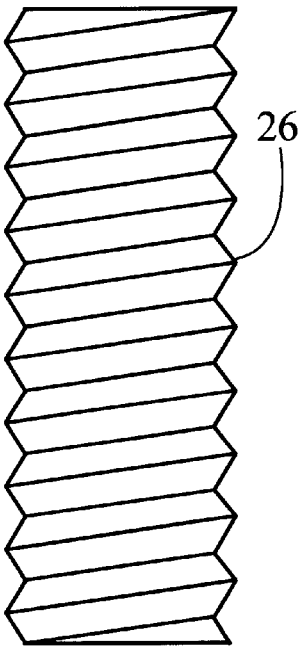
FIG. 14 is an enlarged side elevation view of the eraser.

FIG. 14 is an enlarged side elevation view of a second embodiment of eraser 26. In the first embodiment of the eraser shown in FIG. 6, the eraser is not threaded. In the second embodiment of FIG. 14, eraser 26 is threaded so that it will be held more securely in place by ferrule 24.

Figure 15:
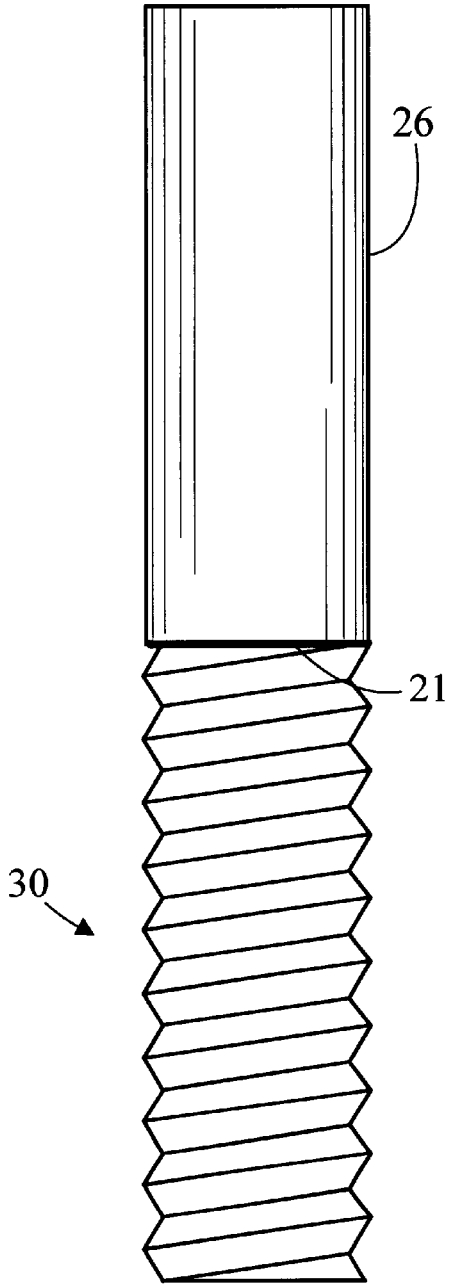
FIG. 15 is an enlarged side elevation view of the eraser and the threaded end of the pencil; and, FIG. 16 is an enlarged side elevation view of the threaded end of the pencil.

FIG. 15 is an enlarged side elevation view of the first embodiment of eraser 26 and threaded end 30 of the pencil. In this embodiment, an adhesive 21 is disposed between threaded end 30 and eraser 26 in order to hold eraser 26 on the end.

Figure 16:
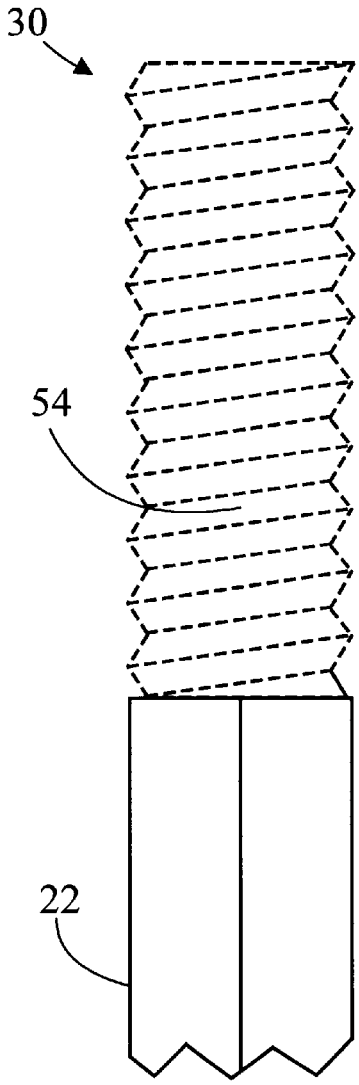

FIG. 16 is an enlarged side elevation view of threaded end 30 of the pencil. In this embodiment, a friction reducing material 54 is disposed upon threaded end 30. Friction reducing material 54 makes it easier to screw ferrule 24 onto threaded end 30. In a preferred embodiment friction, reducing material 54 is a thin plastic sheet such as tetraflourethylene tape sold under the trademark TEFLON® by DuPont of Wilmington, Del.

In terms of use, a method for using a pencil includes:

(a) providing a pencil having an elongated body having a sharpening end and an opposite threaded end, a threaded ferrule threadably engages the threaded end of the pencil, and an eraser is received by the ferrule and projects outwardly therefrom;

(b) using the eraser until a portion thereof is worn away; and, (c) rotating the ferrule to expose an unused portion of the eraser.

Steps (b) and (c) may be repeated a plurality of times as the eraser wears down.

The preferred embodiments of the invention described herein are exemplary and numerous modifications, dimensional variations, and rearrangements can be readily envisioned to achieve an equivalent result, all of which are intended to be embraced within the scope of the appended claims. For example, the body could be made of plastic and the crossectional shape of the body could be cylindrical, triangular, or any other variation thereof And the ferrule could be plastic or any other material instead of metal.

I claim:

1. A pencil, comprising:

an elongated body having a sharpening end and an opposite threaded end;

a threaded ferrule threadably engaging said threaded end of said body;

an eraser received by said ferrule and projecting outwardly therefrom;

so that as said eraser is worn down, said ferrule may by progressively screwed further onto said threaded end of said pencil thereby exposing an unused portion of said eraser;

said ferrule having at least one stop which engages said threaded end of said body of said pencil;

said stop permitting said ferrule to be screwed onto said threaded end in a first direction; and, said stop preventing said ferrule from being screwed off of said threaded end in an opposite second direction.

2. A pencil according to claim 1, further including:

said stop including a pointed member which digs into said threaded end when said ferrule is turned in said second direction.

3. A pencil, comprising:

an elongated body having a sharpening end and an opposite threaded end;

a threaded ferrule threadably engaging said threaded end of said body;

an eraser received by said ferrule and projecting outwardly therefrom;

so that as said eraser is worn down, said ferrule may by progressively screwed further onto said threaded end of said pencil thereby exposing an unused portion of said eraser; and, said eraser being threaded.

* * * * *